United States Patent [19]

Roche

[11] Patent Number: 4,745,708

[45] Date of Patent: May 24, 1988

[54] APPARATUS FOR SECURING A CLOSURE

[75] Inventor: John N. Roche, Greenville, Pa.

[73] Assignee: American Sterilizer Company, Erie, Pa.

[21] Appl. No.: 934,592

[22] Filed: Nov. 25, 1986

[51] Int. Cl.[4] ..... E05C 9/00

[52] U.S. Cl. ..... 49/395; 292/53

[58] Field of Search ..... 49/395, 394; 292/99, 292/30, 53, 29, 49, 98, 96, 129, 195, 197, 229, 241

[56] References Cited

U.S. PATENT DOCUMENTS 4,020,594 5/1977 Ceyer ..... 49/395 X 4,095,640 6/1978 Beckerer, Jr. ..... 49/394 X

*Primary Examiner*—Philip C. Kannan

*Attorney, Agent, or Firm*—Kirkpatrick & Lockhart

[57] ABSTRACT

Apparatus for securing a door of a vessel capable of maintaining pressure therein to its end frame is provided. The apparatus includes a plurality of spring-biased swing hooks pivotally mounted on the end frame which each have a cam surface adjacent the end frame and a hook surface on the opposite side thereof. A corresponding plurality of latch hooks each having a latch surface is provided on the outer portion of the door. A plurality of wedge bars are mounted for horizontal sliding movement on the outer surface of the door toward and away from the corresponding swing hook and are each provided with a cam surface thereon. In the operation of the instant apparatus, the wedge bars are extended toward the respective swing hooks such that the cam surfaces on the wedge bars engage the cam surfaces of the swing hooks thereby rotating the swing hooks against their spring bias. Such swing hook rotation causes the hook surfaces to increasingly engage the latch surfaces which draws the door toward the end frame and into sealing engagement therewith.

20 Claims, 5 Drawing Sheets

APPARATUS FOR SECURING A CLOSURE

BACKGROUND OF THE INVENTION

1. Field of the Invention

The present invention relates to door sealing mechanisms and, in particular, to a device for securely locking and sealing a door of a pressure vessel.

2. Description of the Invention Background

In various applications, a door must be securely fastened to a door frame. In those applications where a door is provided for a pressure vessel, the door must be secured to various points on the door frame of the pressure vessel to assure a balanced loading of the frame by the force of the pressure to allow complete door sealing. For example, in a sterilization apparatus in which the sterilization chamber is pressurized, a suitable door fastening mechanism must be provided to assure uniform door loading to guarantee complete door sealing during chamber pressurization.

Heretofore, various mechanisms have been provided for the securing of a door of a pressure chamber to the frame of the chamber. In certain of these mechanisms, retaining hooks or notched hook bars are provided on both sides of the door frame which are engaged by bars mounted for horizontal sliding movement on the door. The hooks extend inwardly over the door so that the bars may be laterally moved into engagement under the hooks to provide backing support for the bars and, hence, the door, against the pressure within the chamber. However, in such installations, the door is typically mounted for vertical movement between one elevation in which the door may be opened or is in facing relation but not sealed to the end frame and another lower elevation in which the door is in a position sufficient to engage the hooks or hook bars. It will be readily appreciated that in such systems the door must pass through a considerable change in elevation between the upper openable position and the lower position in which the bars may engage the hooks or hook bars. This elevational difference is necessary in order for the notches in the door to clear the hooks or notches in the hook bars. The mechanisms employed to raise the door such a distance must be inordinately massive to allow for the considerable vertical movement of the door thereby significantly increasing the cost and complexity of the door's mechanisms.

Another problem has become apparent in structures where stationary hooks or hook bars are employed on the end frame of the shell to resist the pressure within the chamber. Due to the extension of the stationary hooks or hook bars over the door edges, the door must be constructed wider than otherwise necessary outside the area of the door-mounted seal so that the hooks may engage the door and the ends of the hooks will not interfere with the seal when the door is opened. This oversizing increases the envelope width of the apparatus which translates into a smaller chamber that may be used in a given space. Further, the added door width causes an increase in the bending moment of the arm from the hinges on the door frame which increases the structure of the shell and, hence, the cost thereof.

The subject invention is directed toward an improved means for securing a door of a pressurizable chamber which overcomes, among others, the above-discussed problems and is effective to secure the door without requiring its undue lifting and the costs associated with the mechanisms for doing so.

SUMMARY OF THE INVENTION

In accordance with the present invention, there is provided an apparatus for securing a door of a chamber to the end frame thereof. The end frame of the chamber shell is provided with a series of clevises on either side thereof. The clevises are each provided with a pin on which there is pivotally mounted a swing hook. Each swing hook has a first cam surface in proximity to the end frame and a hook surface formed on the reverse side of the swing hook.

The door is supported on the end frame for swinging movement by means of two or more hinges. A slide plate is mounted on the outside of the door for vertical sliding movement powered by a screw which is connected to the slide plate by means of a nut mounted on the slide plate. The slide plate is provided with symmetrical cam slots formed therein. Vertical longitudinal bars are mounted on the outside of the door for horizontal sliding movement and include rollers mounted on the outer faces thereof. Such rollers are provided to engage the cam slots in the slide plate such that the vertical movement of the slide plate causes the horizontal displacement of the longitudinal bars.

The door is also provided with a series of horizontal wedge bars which are connected to the longitudinal bars for horizontal sliding movement relative to the door corresponding to the horizontal movement of the longitudinal bars. The wedge bars are each provided with a cam surface which may engage the corresponding swing hook. A plurality of latch hooks is provided on the outer surface of the door corresponding to each of the wedge bars. Each of the latch hooks includes a radiused outer surface which may be engaged by the first cam surface of a corresponding swing hook.

The operation of the instant invention is effective to cause the door to be moved from one position in which it is facing the end frame but not secured thereto to another position in which the door is moved toward the end frame in order that the seal provided around the perimeter of the inner door face is in sealing relation with the end frame. In the operation of the instant apparatus, the raising and lowering of the slide plate causes the horizontal displacement of the longitudinal bars and, hence, the wedge bars. Such movement of the wedge bars causes the cam surfaces of the wedge bars to contact the first cam surfaces of the swing hooks to cause the swing hooks to rotate. As the wedge bars are extended, each of the cam surfaces thereof rides further along the first cam surface of the corresponding swing hook thereby rotating it and causing its hook surface to engage the latch surface of the latch hook. As the relative movement between the swing hook and the latch hook occurs, the latch hook and the door are displaced toward the end frame thereby causing the seal to be compressed against the end frame. When the wedge bars are retracted, the compressive force is released and a spring bias of the swing hooks causes them to rotate away from the door.

Accordingly, the present invention provides solutions to the aforementioned problems associated with previous door securing means. As the instant device provides a mechanically expedient door securing means which does not necessitate the excessive lifting of the door, the problems of the prior art sealing devices are alleviated.

These and other details, objects and advantages of the present invention will become apparent as the following description of the present preferred embodiment thereof proceeds.

BRIEF DESCRIPTION OF THE DRAWINGS

In the accompanying drawings, there is shown a present preferred embodiment of the invention wherein.

DETAILED DESCRIPTION OF THE PREFERRED EMBODIMENT

Figure 1:
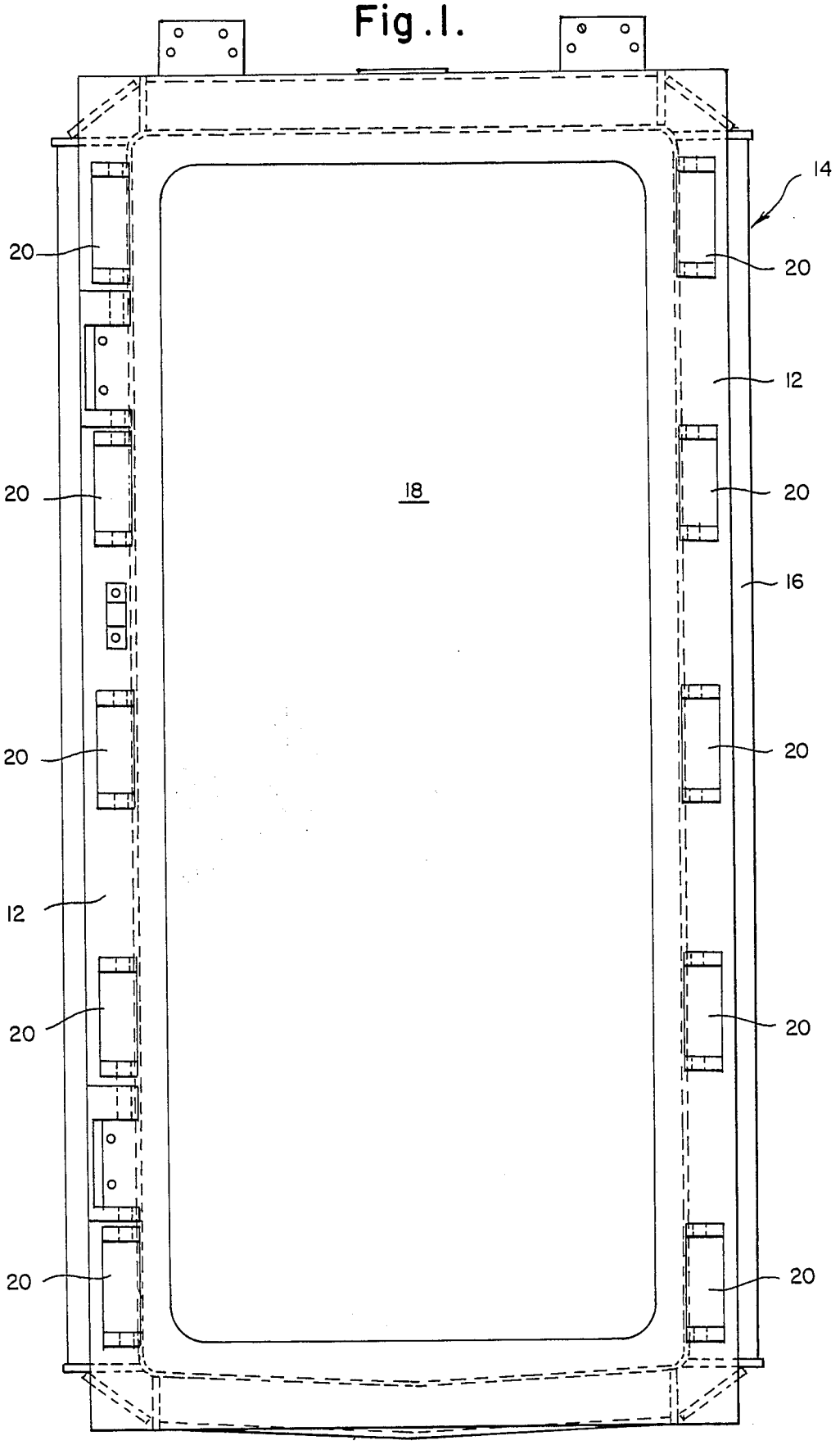
FIG. 1 is a front elevation view of the end frame of a chamber to which the present invention may be applied.
Figure 2:
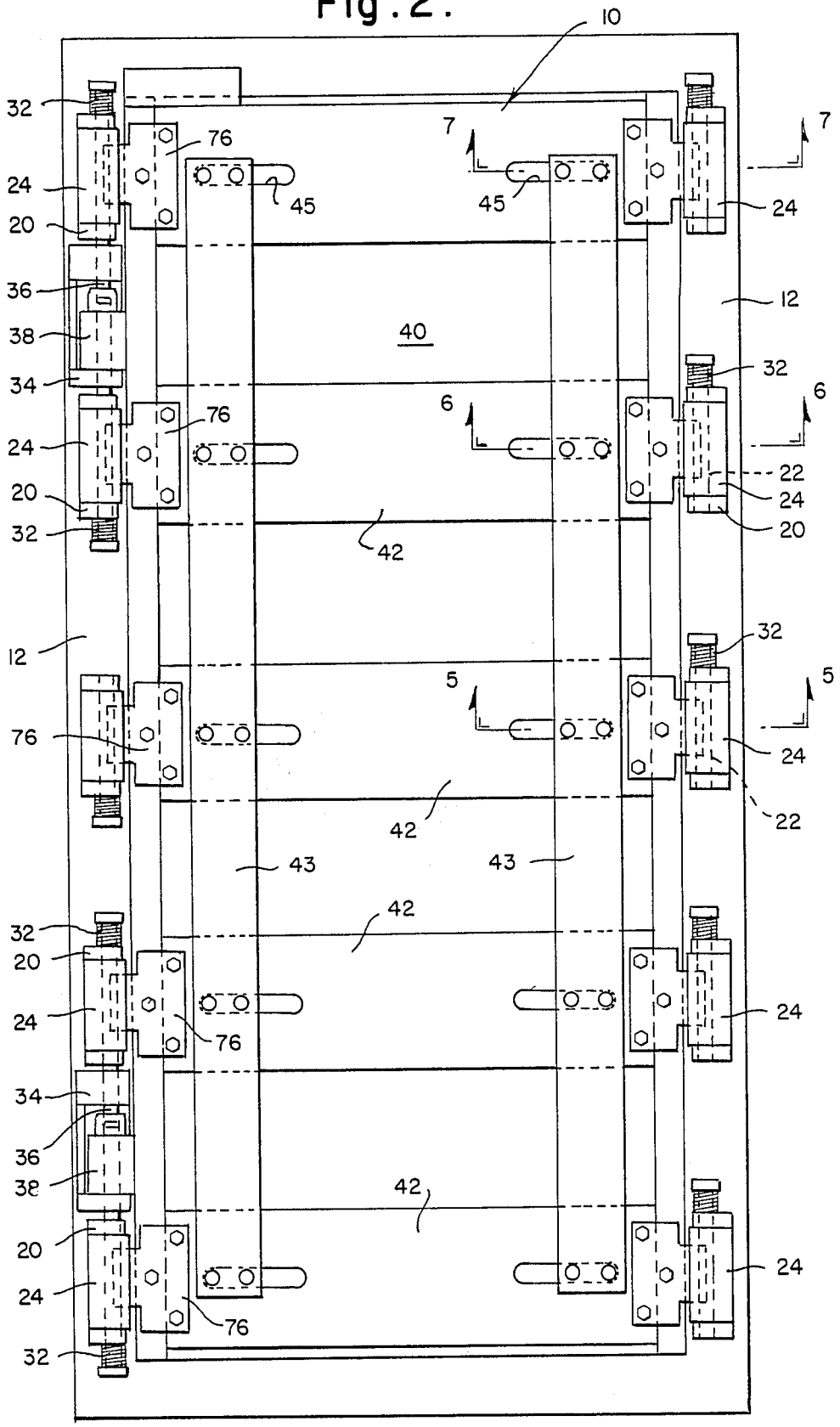
FIG. 2 is a front view of a partially assembled door which includes various aspects of the present invention.
Figure 3:
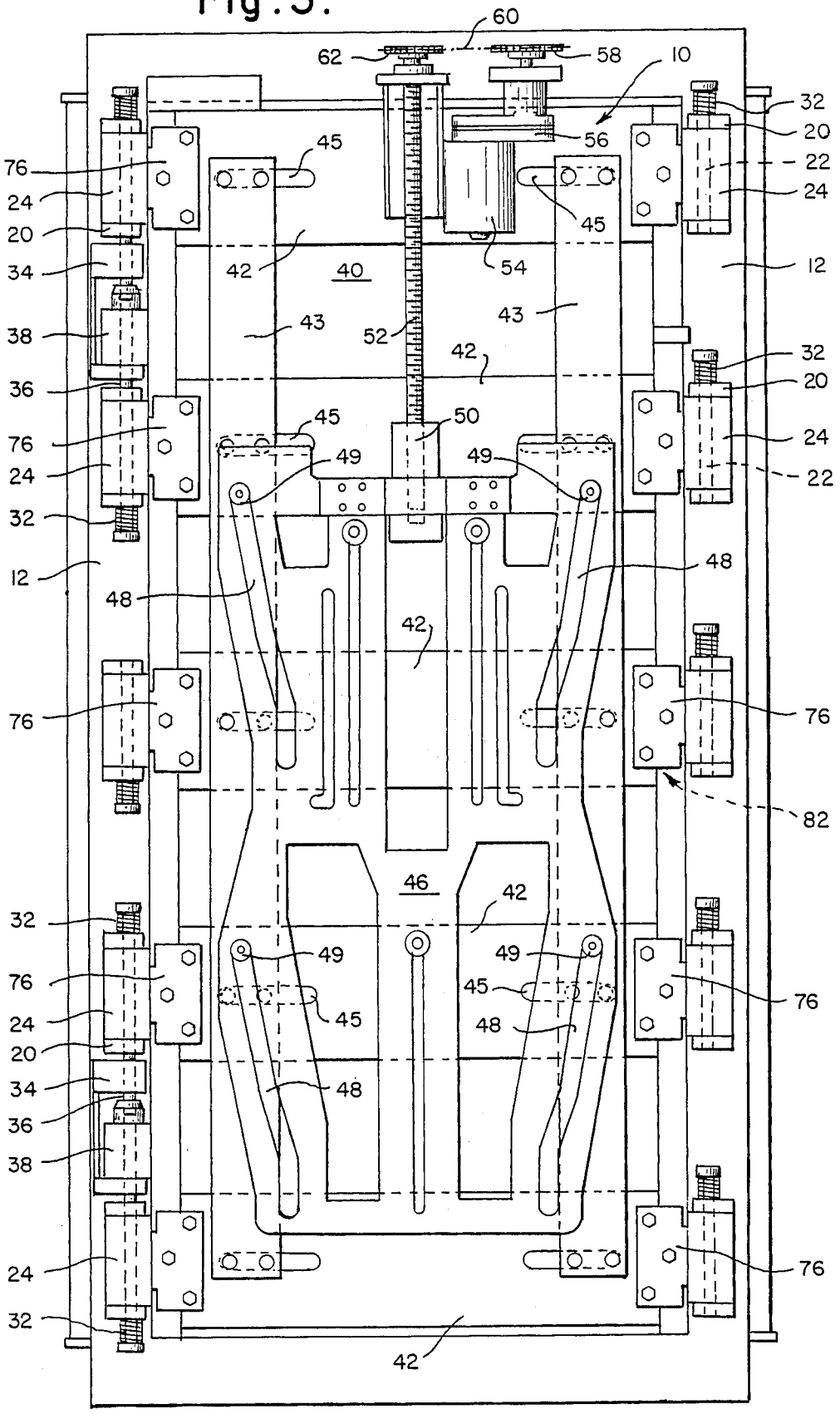
FIG. 3 is a front elevation view of a door which embodies the apparatus of the present invention.

Referring now to the drawings wherein the showings are for purposes of illustrating the present preferred embodiment of the invention only and not for limiting the same, the Figures show a door 10 which may be mounted on the vertical end frame 12 of a vessel 14 having a surrounding shell 16. In the present DETAILED DESCRIPTION OF THE PREFERRED EMBODIMENT, reference will be made to a door 10 of a vessel 14 which may comprise a pressure vessel, such as a sterilization unit, in which the chamber 18 is caused to undergo periods of elevated pressure. However, it will be appreciated that the door latching mechanism disclosed herein may be employed in an environment in which a door must be secured to a door frame.

More particularly, and with reference to FIG. 1, there is shown an end frame 12 of the vessel 14 which is perpendicular to the chamber 18. A seal 19 is provided about the inner circumference of door 12. A plurality of clevises 20 are provided symmetrically on the opposing lateral sides of end frame 12. The clevises 20 are each provided with a pin 22 secured thereto. Pivotally mounted on each pin 22 is a swing hook 24 which includes a first curved cam surface 26 provided on the side of swing hook 24 closest to end frame 12 and a hook portion 28. The hook portions 28 are each provided with an inner curved hook surface 30, the radius of curvature of which is not taken about pin 22. The swing hooks 24 are each normally biased into the open position indicated in FIG. 4, in which the hook portion 28 is not in facing relation to end frame 12, by means of coil springs 32 mounted on pin 22 between such and swing hook 24.

Hinge blocks 34 are provided on end frame 12 to support door 10. The hinge blocks are each provided with pins 36 over which pass loosely fitting hinges 38 which are secured to one of the sides of door 10. As such, door 10 may be moved between an open position in which access to chamber 18 is permitted and a confronting position in which door 10 is in facing relation to end frame 12 but not sealed thereto and a sealed position in which door 10 seals chamber 18.

The door 10 includes a vertical door plate 40 which supports certain of the remainder of the structure of door 10. Door 10 is provided with latereal stiffening channels 42 which comprise "U"-shaped channels configured to provide stiffening structure to door 10 to resist the pressure imposed within chamber 18. Vertical longitudinal bars 43 are provided on the opposing lateral sides of the outer surface of door 10 and are supported on channels 42 by means of rollers 44 which are supported by slots 45 in channels 42. As such, longitudinal bars 43 may move horizontally relative to door 10 on channels 42.

A vertical slide plate 46 is provided to slide vertically along the outer surface of door 10 as described hereinbelow. The slide plate 46 includes cam slots 48 which are primarily vertical in orientation but which are also provided with a horizontal component of displacement. Slide plate 46 is supported on longitudinal bars 43 by means of rollers 49 mounted thereon which engage cam slots 48. A nut 50 is provided on the upper central portion of slide plate 46 and is screwedly engaged by a vertical screw 52 which also serves to support door 10. The movement of slide plate 46 is caused by the rotation of screw 52 which causes nut 50 to travel on screw 52. Hence, slide plate 46 is vertically displaced relative to rollers 49 and longitudinal bars 43. The rotation of screw 52 may be manually powered or, more preferably, is mechanically powered by means of an electric motor 54 which, through a transmission 56, drives a gear 58. The rotational force of gear 58 is transmitted to screw 52 by means of a chain 60 passing between gear 58 and a second gear 62 which is attached to the end of screw 52. Accordingly, the rotation of motor 54 powers screw 52 and, hence, the vertical displacement of slide plate 46. As will be appreciated by those skilled in the art, when slide plate 52 is vertically displaced, the position of rollers 49 in cam slots 48 will vary. Such variation causes longitudinal bars 43 to move horizontally relative to stiffening channels 42.

Figure 5:
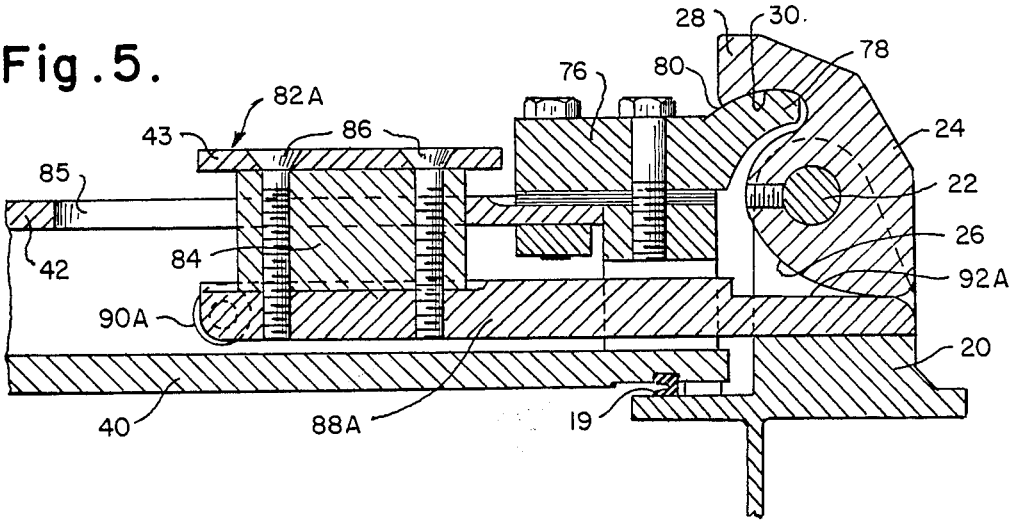
FIG. 5 is a section view taken along line 5—5 in FIG. 2.

Also attached to the outer surfaces of each of the channels 42 are latch hooks 76. Latch hooks 76 are provided with laterally extending hooks 78 having an outer curved latch surface 80 of a radius similar to that of the hook surfaces 30 of swing hooks 24. However, the distance between inner hook surface 30 and end frame 12 when swing hook 24 is in its closed position as shown in FIG. 5 is slightly less than that from latch surface 80 to end frame 12 when door 12 is in its end frame confronting position. In accordance with the present invention, the engagement of latch surface 80 of hook 78 by hook surface 30 is the mechanism by which door 10 is secured to end frame 12.

The securing means by which swing hook 24 is caused to engage latch 78 is generally indicated herein by reference numeral 82. However, due to the construction of door 10, securing means 82 actually may take three separate forms, namely, 82A, 82B and 82C which are essentially equivalent in terms of their function to secure door 10 to end frame 12, but which differ depending on the additional functions they perform.

The securing means 82 which is of the simplest construction is securing means 82A. Securing means 82A includes a spacer block 84 which passes through slot 85 in a stiffening channel 42 and which is fastened to the inside surface of longitudinal bar 43 by means of screws 86. As such, spacer block 84 extends into the interior of the appropriate stiffening channel 42. Attached to the inner surface of spacer block 84 also by means of bolts 86 is a horizontal wedge bar. As the wedge bars which are provided in securing means 82A, 82B and 82C are similar in certain aspects of their function, wedge bars 88A, 88B and 88C will be defined as those associated with securing means 82A, 82B and 82C, respectively. Wedge bar 88A comprises a bar-like member having a roller 90A provided on the lateral end thereof closest to the center of door 10 and a cam surface 92 provided on its outer lateral end. Similarly to the nomenclature previously adopted herein, cam surfaces 92A, 92B and 92C will refer to those which are provided on the faces of wedge bars 88A, 88B and 88C, respectively, which are remote from door plate 40. It will be appreciated that as a longitudinal bar 43 is moved horizontally by the movement of slide plate 46, a wedge bar 88A attached thereto will also be horizontally displaced. When the longitudinal bars 43 are displaced outwardly, the wedge bar 88A is moved toward swing hook 24. This action causes cam surface 92A of wedge bar 88A to engage first cam surface 26 of the corresponding swing hook 24. The continued outward displacement of wedge bar 88A causes cam surface 92A to cause swing hook 24 to rotate in a counterclockwise direction as viewed in FIGS. 4 and 5. Such rotation of swing hook 24 causes the inner hook surface 30 to engage latch surface 80 of hook 78. Due to the fact that the distance between inner hook surface 30 and end frame 12 when swing hook 24 is in its closed position as shown in FIG. 5 is slightly less than that from latch surface 80 to end frame 12 when door 10 is in its end frame confronting position, the continued movement of hook surface 30 relative to latch surface 80 causes the latch hook 76 and, hence, door 10, to move inwardly relative to end frame 12. Due to the loose fit of hinge pin 36 in hinge 38, the door 10 is able to be horizontally displaced toward end frame 12. The movement of door 10 toward end frame 12 causes seal 19 to be compressed the requisite amount to effectuate sealing of chamber 18 by door 10.

Figure 4:
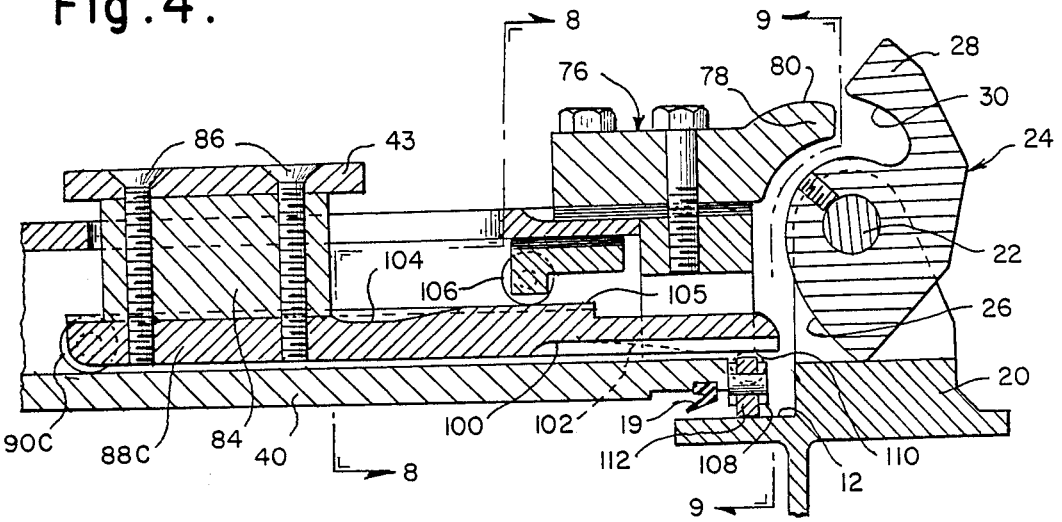
FIG. 4 is a section view of the present invention showing the door securing means in its open position.
Figure 8:
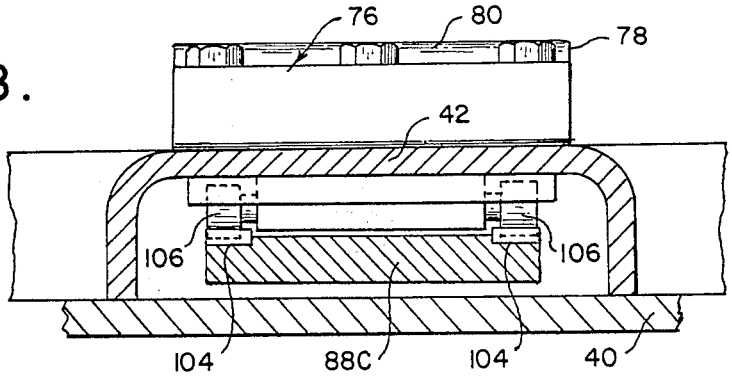
FIG. 8 is a section view taken along line 8—8 in FIG. 4.
Figure 9:
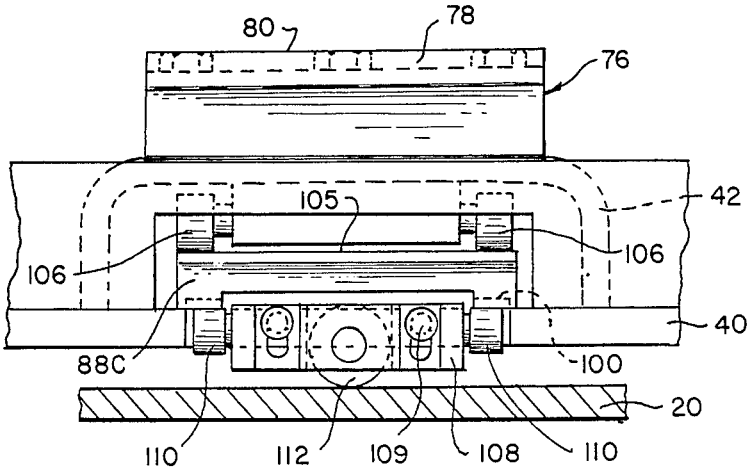
FIG. 9 is a section view taken along line 9—9 in FIG. 4.
Figure 7:
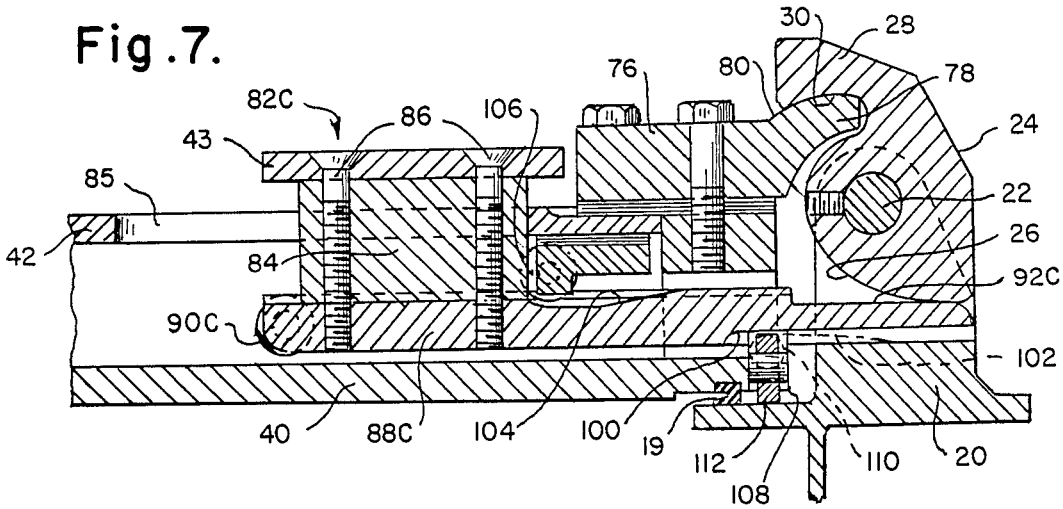
FIG. 7 is a section view taken along line 7—7 in FIG. 2.
Figure 6:
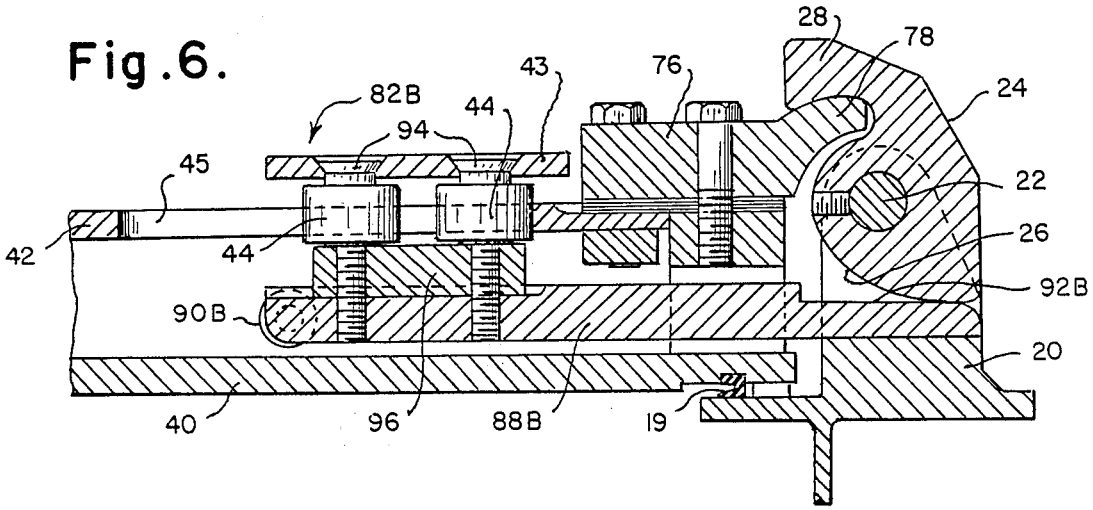
FIG. 6 is a section view taken along line 6—6 in FIG. 2.

The principal difference between the construction of securing means 82A and 82B is that securing means 82B includes the rollers 44 on which the longitudinal bars 43 are mounted. In that construction, screws 94 are provided intermediate longitudinal bar 43 and wedge bar 88B. Rollers 44 are mounted on screws 94 between longitudinal bar 43 and a spacer block 96 mounted on wedge bar 88B. As described previously, the rollers 44 support the longitudinal bars 43 on slots 45 in stiffening channels 42. Wedge bars 88B also include a roller 90B and a cam surface 92B. The operation of securing means 82B is similar to that of securing means 82A. When longitudinal bars 43 are displaced horizontally outward, they are supported by rollers 44 in slots 45 of stiffening channels 42. The outward movement of each of the longitudinal bars 43 causes wedge bar 88B to move outward thereby moving cam surface 92B toward its corresponding swing hook 24. The continued movement of wedge bar 88B causes cam surface 92B to cause swing hook 24 to rotate such that hook surface 30 increasingly engages latch surface 80. The engagement of hook surface 30 with latch surface 80 causes latch 78 to be displaced toward end frame 12 thereby drawing door 10 toward end frame 12 and compresses the seal 19. When wedge bar 88B is retracted, swing hook 24 is rotated to its open position as indicated in FIG. 4.

The securing means 82C, however, incorporates functions in addition to those of the other securing means 82. Securing means 82C includes a wedge bar 88C which is also attached to longitudinal bar 43 by means of screws 86 passing through a spacer block 84 and into wedge bar 88C. A roller 90C is provided on the inboard end of wedge bar 88C. Wedge bar 80C is also provided with a cam surface 92C which functions like cam surfaces 92A and 92B to cause swing hook 24 to engage latch hook 76 and be released therefrom. However, wedge bar 88C is also provided with a first recessed area 100 on the inner side thereof facing door plate 40, which recessed area 100 is operatively adjacent a cam surface 102 also formed on the inner side of wedge bar 88C opposite to cam surface 92C. A second recessed area 104 is formed on the outer surface of wedge bar 92C facing away from door plate 40 and is operatively adjacent to a second cam surface 105. A roller 106 is attached to the underside of channel 42 in facing relation to wedge bar 92C.

A roller block 108 is supported on each of the lateral sides of door plate 40 on pins 109 such that horizontal movement of roller block 108 toward and away from wedge bar 88C is permitted. Roller block 108 is provided with a pair of rollers 110 which are in facing relation to and may ride on first recessed area 100 and first cam surface 102 of wedge bar 92C. A second roller 112 is also provided on roller block 108 which faces and may ride on end frame 12. As such, when wedge bar 92C is retracted into channel 42, rollers 110 are seated in first recessed area 100 and second roller 104 is seated in recessed area 104 and roller 112 is not in engagement with end frame 12. When wedge bar 88C is extended toward swing hook 24, rollers 110 are caused to ride on cam surface 102 to the elevated area thereof. This action causes wedge block 108 and, hence, roller 112 to be extended relative to end frame 12 thereby causing door 10 to be displaced therefrom by an amount sufficient to break the seal at seal 19 to allow door 12 to be opened. The action of rollers 110 on cam surface 102 is opposed by roller 106 which rides on cam surface 105 when wedge bar 92C is retracted so that wedge bar 92C is not subject to excessive bending stresses.

In the operation of the present invention, in order for the door 10 to be opened relative to end frame 12, the slide plate 46 must be moved to its maximum upper position by means of the action of motor 54 driving screw 52 which is coupled to nut 50.

When it is desired to seal the door 10 to end frame 12, the motor 54 rotates screw 52 in one direction thereby causing nut 50 and slide plate 46 to be lowered. The continued lowering of slide plate 46 relative to door 40 causes the longitudinal bars 43 to be moved horizontally outward toward the outer edges of door 10 and toward the swing hooks 24.

Reference will now be made to the operation of one of the securing means 82C with it being understood that the actions of securing means 82A and 82B being similar with the exceptions as described hereinabove. When longitudinal bar 43 is moved outwardly, wedge bar 88C will also be moved outwardly. Such movement causes cam surface 92C on wedge bar 88C to engage the first cam surface 26 of swing hook 24. The continued outward displacement or extension of wedge bar 88C causes cam surface 92C to cause first cam surface 26 to be displaced thereby causing swing hook 24 to be rotated relative to pin 22. The rotation of swing hook 24 causes its hook surface 30 to engage latch surface 80 of latch 78. The further engagement of latch surface 80 by hook surface 30 causes the latch 78 and, hence, the door 10 to which it is mounted, to be displaced toward end frame 12. During the extension of wedge bar 88C, the roller 110 passes from raised cam surface 102 to recessed area 100 and roller 106 from raised cam surface 106 to recessed area 104 thereby relieving any force by roller block 108 on door 10.

In the position in which the wedge bar 88C has rotated swing hook 24 to its maximum extent, an additional feature of the present invention serves to provide security to the door 10 retaining mechanism provided herein. In that position, when pressure is applied to the chamber and, hence, door 10 tends to force door 10 and latch hook 76 outward from end frame 12. However, such pressure on latch hook 76 causes latch surface 80 to attempt to rotate swing hook 24 to its open position. However, such attempted rotation causes first cam surface 26 of swing hook 24 to transmit the rotational force to cam surface 92C of wedge bar 88C and press wedge bar 88C against the clevis 20. This action further prevents the retraction of wedge bar 88C and any opening of door 10 under conditions of pressure.

When the slide plate 46 is raised, wedge bar 88C is retracted or drawn toward the center of door 10 and its cam surface 92C is retracted relative to first cam surface 26 of swing hook 24 thereby removing the force thereon which, in turn, allows swing hook 24 to be rotated by the force of spring 32 to its open position. Simultaneously with the retraction of wedge bar 88C, first roller 110 of roller block 108 is caused to ride on raised cam surface 102 which causes a force directed toward end frame 12 to be provided on roller block 108 and, hence, roller 112 thereby causing it to press against end frame 12 to break the seal formed by seal 19. The force created by roller 110 on surface 102 is resisted by roller 106 riding on cam surface 105 to prevent bending of wedge bar 88C. The roller 90C serves to prevent the inner end of wedge bar 88C from contacting the inner surface of door plate 40.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for securing a door to a door frame comprising:

(a) a swing hook rotatably mounted on said door frame, said swing hook having a first cam surface in proximity to said door frame and a hook having a hook surface remote from said door frame, said swing hook being rotatable between an open position in which said first cam surface is not in facing relation to said door frame and a latched position;

(b) a latch hook mounted on said door adjacent the edge thereof, said latch hook having a latch surface which is engaged by said hook surface when said swing hook is in said latched position so as to secure said door to said door frame; and (c) means mounted on said door for rotating said swing hook from its open position to its latched position.

2. Apparatus of claim 1 in which said means for rotating comprises:

(a) a wedge bar mounted on said door for sliding movement, said wedge bar having a cam surface thereon, said wedge bar being movable from a retracted position remote from said swing hook to an extended position in which said cam surface is in engagement with said first cam surface, so that the movement of said wedge bar from said retracted position to said extended position causes said swing hook to be rotated from said open position to said latched position; and (b) means on said door for moving said wedge bar from said retracted position to said extended position.

3. Apparatus of claim 1 further comprising means for normally biasing said swing hook to said open position.

4. Apparatus for securing a vertical door of a chamber to the end frame of the chamber which defines the opening thereof comprising:

(a) at least one swing hook provided on each lateral side of said end frame, each of said swing hooks being rotatably mounted on said end frame and having a first cam surface in proximity to said end frame and a hook having a hook surface remote from said end frame, each said swing hook being rotatable between an open position in which said first cam surface is not in facing relation to said end frame and a latched position;

(b) a plurality of latch hooks mounted on said door adjacent the lateral edges thereof with a latch hook being provided on said door corresponding to each swing hook, each latch hook having a latch surface which is engaged by the hook surface of the corresponding swing hook when it is in its latched position; and (c) means mounted on said door for rotating each said swing hook from its open to its latched position.

5. Apparatus of claim 4 in which said means for rotating comprises:

(a) a plurality of wedge bars mounted on said door for horizontal sliding movement, with a wedge bar being provided on said door corresponding to each swing hook, each wedge bar having a cam surface thereon, each said wedge bar being movable from a retracted position remote from the corresponding swing hook to an extended position in which said cam surface is in engagement with the said first cam surface of the corresponding swing hook so that the movement of each said wedge bar from its said retracted position to its said extended position causes the corresponding swing hook to be rotated from its said open position to its said latched position; and (b) means mounted on said door for moving each of said wedge bars from its retracted position to its extended position.

6. Apparatus of claim 5 further comprising means for simultaneously moving all of said wedge bars from their retracted positions to their extended positions.

7. Apparatus of claim 6 in which said means for simultaneously moving comprises:

(a) a first longitudinal bar horizontally slidably mounted on one lateral side of said door and connected to each of the wedge bars on said one lateral side of said door;

(b) a second longitudinal bar horizontally slidably mounted on the other lateral side of said door and connected to each of the wedge bars on said other lateral side of said door; and (c) means for horizontally sliding said first and said second longitudinal bars simultaneously.

8. Apparatus of claim 7 in which said means for horizontally sliding comprises:

(a) a slide plate which is mounted on said door for vertical sliding movement, said slide plate having at least one cam slot on one lateral side thereof and at least one other symmetrical cam slot on the opposite lateral side thereof, said cam slots each extending longitudinally and laterally of said slide plate;

(b) means mounted on said first longitudinal bar for followingly engaging said at least one cam slot;

(c) means mounted on said second longitudinal bar for followingly engaged said other cam slot; and (d) means for vertically displacing said slide plate.

9. Apparatus of claim 8 in which said means for vertically displacing said slide plate comprises:

(a) a vertical threaded nut mounted on said slide plate;

(b) a vertical threaded screw mounted on said door for rotational movement, said screw being screwedly connected to said nut;

(c) a motor mounted on said door and having a rotational output; and (d) means for connecting the rotational output of said motor to said vertical screw.

10. Apparatus of claim 4 further comprising means for normally biasing each of said swing hooks into its open position.

11. Apparatus for sealing a chamber having an end frame which defines an opening to said chamber comprising:

(a) a door having a seal disposed about the periphery of its internal surface, said door being mounted on said end frame for movement between a confronting position in which said door is in facing relation to said end frame but not sealed thereto, a sealed position in which said seal of said door is in sealing relation with said end frame and an open position in which access may be had to the chamber;

(b) at least one swing hook provided on each lateral side of said end frame, each of said swing hooks being rotatably mounted on said end frame and having a first cam surface in proximity to said end frame and a hook having a hook surface remote from said end frame, each said swing hook being rotatable between an open position in which its first cam surface is not in facing relation to said end frame and a latched position;

(c) a plurality of latch hooks mounted on said door adjacent the lateral edges thereof with a latch hook being provided on said door corresponding to each swing hook, each latch hook having a latch surface which is engaged by the hook surface of the corresponding swing hook when it is in its latched position so that said door is in its sealed position and when the corresponding swing hook is in its open position the hook surface thereof is not in engagement with the corresponding latch hook; and (d) means for rotating each said swing hook from its open position to its latched position.

12. Apparatus of claim 11 in which said means for rotating comprises:

(a) a plurality of wedge bars mounted on said door for horizontal sliding movement, with a wedge bar being provided on said door in facing relation to each said swing hook when said door is in said confronting position, each wedge bar having a second cam surface thereon on the side of said wedge bar remote from said door, each said wedge bar being movable from a retracted position remote from the corresponding swing hook to an extended position in which said second cam surface thereof is in engagement with the first cam surface of the corresponding swing hook such that the movement of each of said wedge bars from its retracted position to its extended position causes the corresponding swing hook to be rotated from its said open position to its said latched position; and (b) means mounted on said door for moving each of said wedge bars from its retracted position to its extended position.

13. Apparatus of claim 12 further comprising means for simultaneously moving all of said wedge bars from their retracted positions to their extended positions.

14. Apparatus of claim 13 in which said means for simultaneously moving comprises:

(a) a first longitudinal bar horizontally slidably mounted on one lateral side of said door and connected to each of the wedge bars on said one lateral side of said door;

(b) a second longitudinal bar horizontally slidably mounted on the other lateral side of said door and connected to each of the wedge bars on said other lateral side of said door; and (c) means for horizontally sliding said first and said second longitudinal bars simultaneously.

15. Apparatus of claim 14 in which said means for horizontally sliding comprises:

(a) a slide plate which is mounted on said door for vertical sliding movement, said slide plate having at least one cam slot on one lateral side thereof and at least one other symmetrical cam slot on the opposite lateral side thereof, said cam slots each extending longitudinally and laterally of said slide plate;

(b) means mounted on said first longitudinal bar for followingly engaging said at least one cam slot;

(c) means mounted on said second longitudinal bar for followingly engaged said other cam slot; and (d) means for vertically displacing said slide plate.

16. Apparatus of claim 15 in which said means for vertically displacing said slide plate comprises:

(a) a vertical threaded nut mounted on said slide plate;

(b) a vertical threaded screw mounted on door for rotational movement, said screw being screwedly connected to said nut;

(c) a motor mounted on said door and having a rotational output; and (d) means for connecting the rotational output of said motor to said vertical screw.

17. Apparatus of claim 11 further comprising means for normally biasing each of said swing hooks into its open position.

18. Apparatus of claim 11 further comprising means for returning said door from its sealed to its confronting position.

19. Apparatus of claim 18 in which said means for returning comprises:

(a) a roller movably mounted on the edge of said door adjacent to one of said wedge bars such that when said door is in said confronting position said roller is in one position in engagement with said end frame so as to displace said door from its sealed position to its confronting position and when said door is in said sealed position said roller is in a second position not in engagement with said end frame;

(b) a third cam surface on said one wedge bar on the opposite side thereof from said second cam surface, said third cam surface being configured such that when said one wedge bar is in its retracted position said roller is in said one position and when said one wedge bar is in its extended position said roller is in its second position.

20. Apparatus of claim 19 further comprising:

(a) another roller mounted on said door in facing relation to the side of said one wedge bar on which said second cam surface is provided;

(b) a fourth cam surface on said wedge bar adjacent to said cam surface, said fourth cam surface being configured such that when said one wedge bar is in its retracted position said other roller is in engagement with said fourth cam surface and when said wedge bar is in its extended position said roller is not in engagement with said fourth cam surface.

* * * * *

UNITED STATES PATENT AND TRADEMARK OFFICE

CERTIFICATE OF CORRECTION

PATENT NO. : 4,745,708

DATED : May 24, 1988

INVENTOR(S) : John N. Roche

It is certified that error appears in the above-identified patent and that said Letters Patent is hereby corrected as shown below:

Col. 3, line 42, delete "an", and substitute therefor --any--.

Col. 4, line 5, delete "latereal", and substitute therefor --lateral--.

Col. 4, line 50, delete "12", and sustitute therefor --10--. (2nd occurrence)

Col. 6, line 37, delete "12", and substitute therefor --10--.

Col. 7, line 5, delete "106", and substitute therefor --105--.

Col. 7, line 51, delete "door", and therefor substitute --end--.

Signed and Sealed this

Twenty-first Day of February, 1989

*Attest:*

DONALD J. QUIGG

*Attesting Officer*

*Commissioner of Patents and Trademarks*